United States Patent [19]

Sweeten

[11] Patent Number: 5,072,713

[45] Date of Patent: Dec. 17, 1991

[54] FILTER FOR LOWERING HARMFUL CRANKCASE EMISSIONS IN AN INTERNAL COMBUSTION ENGINE

[75] Inventor: Theodore P. Sweeten, Paulden, Ariz.

[73] Assignee: Ventures Unlimted Inc., Paulden, Ariz.

[21] Appl. No.: 607,586

[22] Filed: Nov. 1, 1990

Related U.S. Application Data

[63] Continuation-in-part of Ser. No. 542,721, Jun. 25, 1990.

[51] Int. Cl.[5] ..... F02M 25/00

[52] U.S. Cl. ..... 123/573; 123/572

[58] Field of Search ..... 123/572, 573, 574

[56] References Cited

U.S. PATENT DOCUMENTS

| | | | |
|---|---|---|---|
| Re. 30,682 | 7/1981 | Bush | 123/573 |
| 4,167,164 | 9/1979 | Bachman | 123/574 |

FOREIGN PATENT DOCUMENTS

| | | | |
|---|---|---|---|
| 0051120 | 3/1984 | Japan | 120/573 |
| 2155998 | 9/1985 | Japan | 123/573 |

*Primary Examiner*—Andrew M. Dolinar
*Assistant Examiner*—M. Macy
*Attorney, Agent, or Firm*—Jordan M. Meschkow; Don J. Flickinger

[57] ABSTRACT

Apparatus for receiving crankcase emissions from an internal combustion engine and for separating the liquid portions of the emissions from the gaseous portion thereof. The apparatus includes a mounting flange, a beveled surface for the return of the liquids to the engine, at least one layer of filtering material. In one embodiment, the filtering material may be soaked with oil. Another embodiment, with multiple layers of filtering material has an air space between each layer. The apparatus includes an outlet for return of the gaseous portion of the emissions to return to the combustion chamber via the PCV line or the induction manifold.

12 Claims, 2 Drawing Sheets

FILTER FOR LOWERING HARMFUL CRANKCASE EMISSIONS IN AN INTERNAL COMBUSTION ENGINE

This invention is a continuation-in-part of my pending application, filed 25 June 1990, and assigned Ser. No. 07/542,721.

FIELD OF THE INVENTION

This invention relates to the field of air pollution control of harmful crankcase emissions from the internal combustion engine, and more particularly to a filtering device for reducing these emissions.

BACKGROUND OF THE INVENTION

The internal combustion engine contains harmful pollutants in its crankcase. These pollutants are caused by blow-by gases from the combustion chamber and the rotating action of the crankshaft turning in the crankcase. In the past these harmful emissions were vented into the air via a road draft tube, or through a PCV valve into the combustion chamber of the engine.

A number of inventions have tried to reduce harmful crankcase emissions with varying degrees of success. For previous inventions in this field, see U.S. Pat. Nos. 3,450,114; 3,463,132; 3,779,221; 4,089,309; 4,167,164; and 4,370,971. These inventions have in common either a vent to atmospheric air, a container for collecting harmful emissions, or a combination of both in many cases.

The prior art generally uses one or both of these parts to filter or separate harmful crankcase emissions. Use of such components is problematic for at least two reasons.

Atmospheric venting allows the drawing in of air into the combustion chamber. This adversely affects computerized automobiles. The computerized vehicle is designed to allow air only into the combustion chamber via the intake manifold. The California Air Resources Board does not allow the use of the air vent shown in U.S. Pat. No. 4,370,971 on cars equipped with either three-way catalyst or oxidation catalyst. See California Air Resources Board Executive order #D-69-4. The sale of this product in California is only allowed when the atmospheric vent is plugged.

It is also not desirous to have a collection camber that stores separated solid and liquid portions of the crankcase emissions from the crankcase because a toxic waste is created. Furthermore this toxic waste must then be disposed of, creating unnecessary and burdensome problems for the consumer.

The present invention is designed to reduce emissions without a collection chamber, so there is no collection of toxic waste. It accomplishes this by means of a unique filtration system that separates the filter material by air spaces and allows the heavy hydrocarbons to flow back into the combustion chamber. The present invention is an improvement over previous inventions because it accomplishes more complete filtration of heavier unburnable hydrocarbons without the use of an air vent to the atmosphere or a collection canister to store the liquid portion of the crankcase emissions.

SUMMARY OF THE INVENTION

It is an object of this invention to provide a pollution control device for reducing harmful crankcase emissions from the internal combustion engine.

It is additionally an object of this invention to provide a device that can be adapted to a variety of internal combustion engines.

It is a further object of t his invention to provide a pollution control device that is easy to install, economical to use, and requires no maintenance for trouble free operation by means of a special filtering system not used before in an internal combustion engine for separating harmful crankcase emissions.

An additional object of this invention is to eliminate the creation of a toxic waste created by other devices using a collection chamber to store separated blow-by gases.

It is also the object of this invention to provide a filter—separator that has no atmospheric air vent to aid in the separation of the blow-by gases.

Other objects, together with the foregoing are contained in the embodiment described in the following description and illustrated in the accompanying drawings.

DETAILED DESCRIPTION OF THE PREFERRED EMBODIMENT

While the crankcase filter of this invention is susceptible of numerous physical embodiments, depending on the requirements of use, substantial numbers of the herein shown and described embodiment have been made and tested and all have performed with excellent results in reducing harmful emissions.

Figure 1:
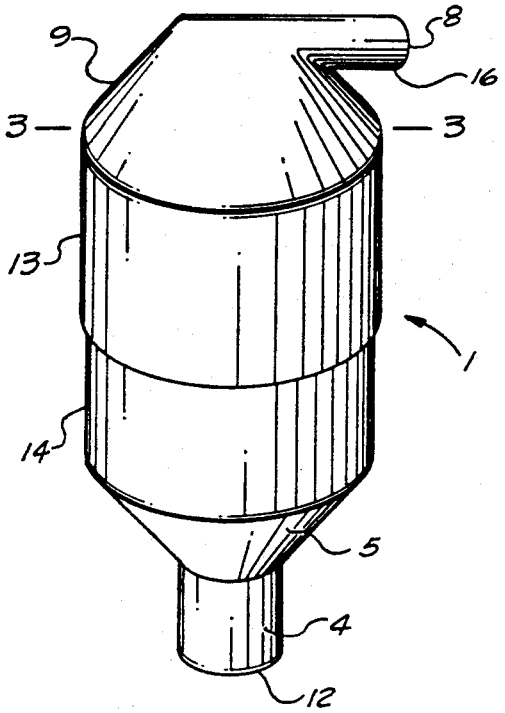
FIG. 1 is a perspective view of the invention.
Figure 2:
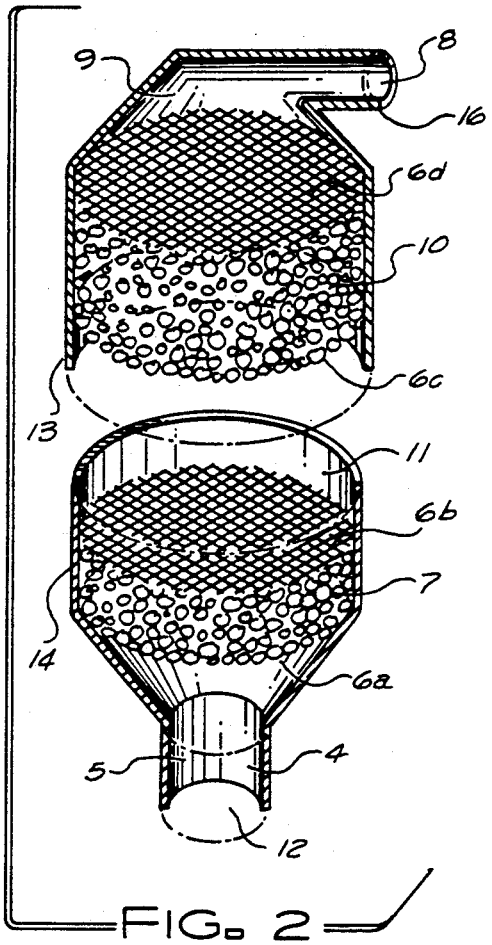
FIG. 2 is a sectional view of the unit constructed in accordance with the teachings of the present invention.

Crankcase filter 1 shown in FIG. 1 is utilized in conjunction with an internal combustion engine (not shown). With reference to FIG. 2 the device comprises two cylindrical housings 13 and 14. Inlet 12 allows the entrance of harmful crankcase emissions and outlet 8 allows for filtered gases to pass on to the combustion chamber via the PCV line in an automobile or the induction manifold on a diesel engine. Alternate embodiments may include an internal PCV valve rather than using the external one currently on cars. This arrangement would further simplify installation of the present invention.

Mounting flange 4 is designed to fit the crankcase outlet of an internal combustion engine. Beveled surface 5 is placed just above the inlet 12 to allow the flow of heavier hydrocarbons back into the crankcase. Screen 6*a* is placed at the top end of beveled surface 5 to hold an assortment of adsorbent silica gel particles 7 used to filter out heavy hydrocarbons. Screen 6*b* is placed on top of the layer of silica gel particles to hold them in place.

The top half of filter 1 has outlet 8 in flange 16 to connect with the existing PCV Valve or induction manifold of the internal combustion engine. A standard PCV valve common to today's gasoline engines (not shown) may also be incorporated into this filter to further simplify installation of the unit. The top portion of filter 1, contains a beveled surface 9, to help prevent any heavier hydrocarbons from entering into the combustion chamber. Screen **6*d* along with screen 6*c*, holds a unique combination of silica gel and carbon particles 10 for final filtration of heavy unburnable hydrocarbons. Housing 13 is joined with housing 14 by glue forming air space 11 between the two layers of silica gel and carbon particles. Housing 14 is slightly smaller in diameter than housing 13 to allow it to slide partway up into housing 13 for assembly of filter 1**. Alternate embodiments of this invention may incorporate several layers of silica gel and carbon particles with air spaces between them.

Figure 3:
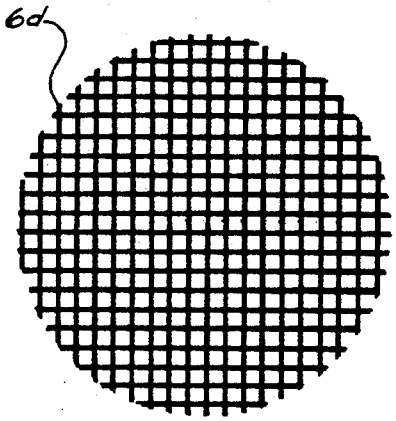
FIG. 3 is a sectional view of the invention taken along line 3—3 of FIG. 1.
Figure 4:
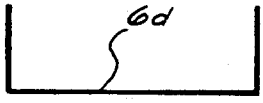
FIG. 4 is a side view of the screen in FIG. 3.

FIGS. 3 and 4 show screen **6*d* used to hold the silica gel and carbon particles It is also representative of screens 6*a*, *b*, and *c***. This screen material is made of either plastic or stainless steel or a combination of both depending on production requirements.

Figure 5:
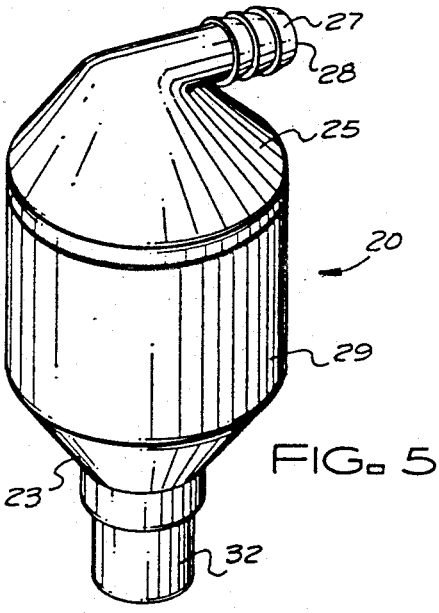
FIG. 5 is a perspective view of an alternate embodiment of the invention.
Figure 6:
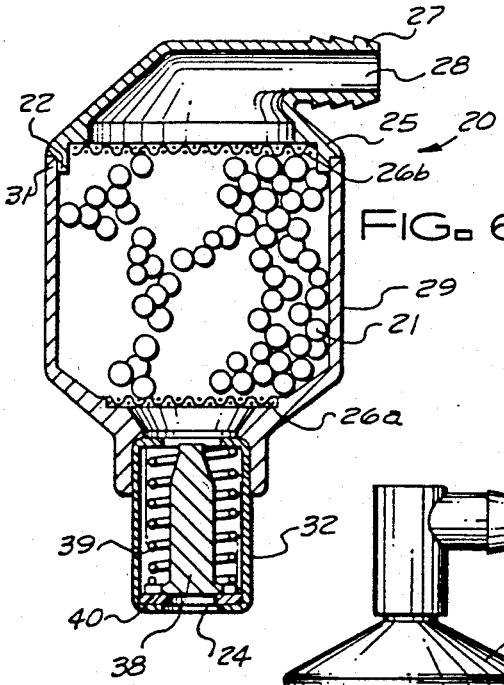
FIG. 6 is a cutaway view of the alternate embodiment of the invention in FIG. 5, taken vertically through the center of the alternate embodiment of the invention shown in FIG. 5.

An alternate embodiment of the present invention is shown in FIG. 5, characterized by reference number 20. A cutaway view of filter 20 is shown in FIG. 6, and will be integrally referred to herein.

Two housings, upper housing 25 and lower housing 29 hold the contents of the invention. In the embodiment shown, housing 25 and housing 29 are press-fit together with upper housing flange 22 and lower housing flange 31. This press-fit connection may be furthered strengthened by using glue, or welding or melting.

Inlet housing 32 is coupled to the engine crankcase either directly or with a hose, and allows the entrance of harmful crankcase emissions into the filter through aperture 24. Outlet 27 has aperture 28 which allows filtered gases to pass on to the combustion chamber via the PCV line in an automobile or the induction manifold on a diesel engine. As shown, outlet 27 also has ridges to firmly hold the PCV line or the induction manifold.

Inlet 32 is designed to fit the crankcase outlet of an internal combustion engine. The housing of inlet 32 press-fits into housing 29.

Like before, beveled surface 23 is placed just above inlet 32 to allow the flow of heavier hydrocarbons back into the crankcase. Screen **26*a* is placed at the top end of beveled surface 23 to hold an assortment of adsorbent silica bead particles 21 used to filter out heavy hydrocarbons. Silica bead particles 21 are typically Silica Dioxide. The performance of silica bead particles 21** has been found to have been greatly enhanced by soaking them in an oil enhancing product, such as STP, Morey's Stabilizer or Energy Release.

Screen **26*b* is placed on top of silica bead particles 21** to hold them in place.

As shown in FIG. 6, a standard PCV valve common to today's gasoline engines may also be incorporated into this filter to further simplify installation of the unit. Inlet 32 houses spring 39 and valve 38, which acts as a PCV valve. Washer 40 is used for maintaining the closed position of valve 38. Those skilled in the art will understand that for vehicles with a PCV valve, or for vehicles that do not require a PCV valve, washer 40, spring 39, and valve 38 may be omitted.

Figure 7:
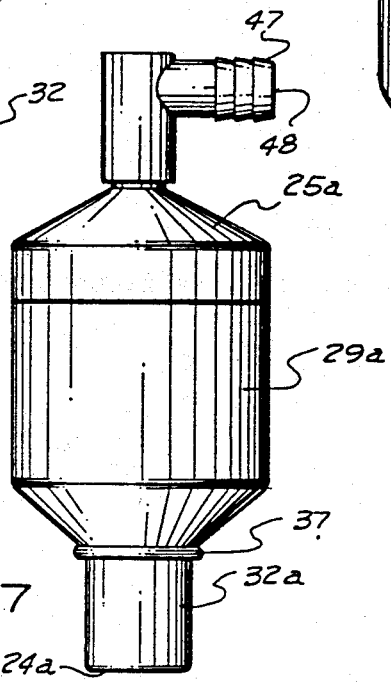
FIG. 7 is a perspective view of yet another alternate embodiment of the invention.
Figure 8:
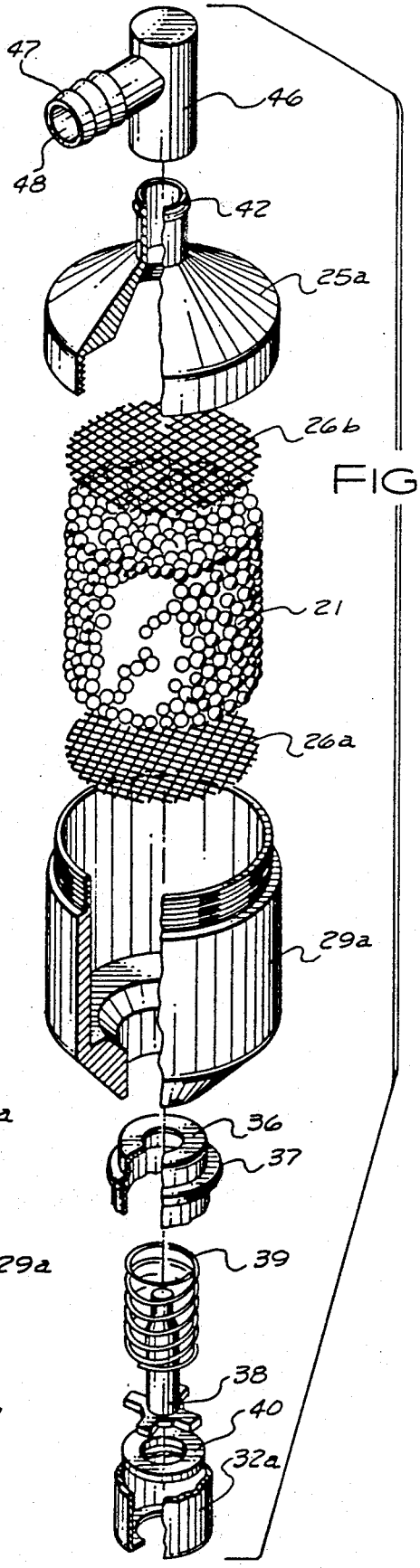
FIG. 8 is an exploded view of the alternate embodiment of the invention in FIG. 7.

FIGS. 7 and 8 show still another alternate embodiment. This alternate embodiment closely resembles the last one, but this one has a metal housing.

Due to its metal housing, housings **25*a* and 29*a* are screw-fitted. Further, outlet 47 with aperture 48 is coupled to outlet adapter 46. Outlet adapter 46 couples to housings 25*a* by way of coupler 42**.

Another significant feature, which could be incorporated into the former embodiments, is shoulder 37 of inlet housing **32*a*. Shoulder 37 allows inlet housing 32*a*** to be inserted at a predetermined depth, thereby regulating current flow.

OPERATION OF INVENTION

Crankcase emissions flow up from the bottom of the filter 1 via flange 4 through silica gel 7 where the liquid portions of the crankcase emissions are prevented from further penetration into the filtering element by the thousands of jagged edges formed by the silica gel granules. Heavier hydrocarbons are also filtered by these jagged edges thus separating unburnable oils and gases from the lighter burnable hydrocarbons.

The gases then pass through air space 11 which aids in preventing further penetration of the heavier hydrocarbons to silica gel and carbon particles 10. The combination of silica gel and carbon particles further trap heavier hydrocarbons to prevent their passage into the combustion chamber as the gas travels through outlet 8.

The operation of the alternate embodiments shown in FIGS. 5 through 8 will be clear to those skilled in the art from the foregoing.

Crankcase emissions by vacuum are pulled into inlet 32, past PCV valve 38, where they contact oil additive coated silica bead particles 21. The coating bridges the gap in the silica beads.

This forms a mucous-like membrane barrier between the gaps in the silica bead particles 21. This membrane stops the passage of liquid and solids into the combustion chamber. Only clean, combustible gases are allowed to pass through this filter. The liquid portions of the crankcase emissions drain back into the crankcase every time the engine is shut off thus eliminating the need for a canister to collect the liquids.

Various changes and modifications to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. In combination with a crankcase vent connected to an internal combustion engine, a device for separating harmful emissions, said device consisting of:

a housing unit;

an inlet for taking in crankcase emissions a beveled surface for return of liquid portions of said crankcase emissions via said inlet;

silica beads to filter harmful crankcase emissions; and viscous fluid coating said silica beads.

2. The apparatus of claim 1 wherein said viscous fluid is STP.

3. The apparatus of claim 1 wherein said viscous fluid is Energy Release.

4. The apparatus of claim 1 wherein said viscous fluid is Morey's Stabilizer.

5. The apparatus of claim 1 wherein said silica beads are Coated with said Viscous fluid by soaking said beads in said viscous fluid prior to encasing them in said housing.

6. The apparatus of claim 1 wherein said silica beads are coated with said viscous fluid as the engine is run.

7. In combination with a crankcase vent connected to an internal combustion engine, a device for separating harmful emissions, said device consisting of:

a housing unit;

an inlet for taking in crankcase emissions a beveled surface for return of liquid potions of said crankcase emissions via said inlet;

filtering material to filter crankcase emissions; and viscous fluid coating said filtering material.

8. The apparatus of claim 7 wherein said viscous fluid is STP.

9. The apparatus of claim 7 wherein said viscous fluid is Energy Release.

10. The apparatus of claim 7 wherein said viscous fluid is Morey's Stabilizer.

11. The apparatus of claim 7 wherein said filtering material is coated with said viscous fluid by soaking said material in said viscous fluid prior to encasing them in said housing.

12. The apparatus of claim 7 wherein said filtering material is coated with said viscous fluid as the engine is run.

* * * * *